United States Patent [19]

Senior et al.

[11] 4,281,442

[45] Aug. 4, 1981

[54] APPARATUS FOR APPLYING CONNECTORS TO MULTICONDUCTOR FLAT CABLE

[75] Inventors: Robert B. Senior, Grand Haven; Frederick Karasinski, Grand Rapids, both of Mich.

[73] Assignee: Cooper Industries, Inc., Houston, Tex.

[21] Appl. No.: 49,842

[22] Filed: Jun. 18, 1979

[51] Int. Cl.[3] ..... H01R 43/00

[52] U.S. Cl. ..... 29/33 M; 29/564.1; 29/749; 29/757; 29/857

[58] Field of Search ..... 29/33 M, 757, 753, 748, 29/749, 564.3, 564.4, 747, 564.6, 564.8, 566.4, 564.1

[56] References Cited

U.S. PATENT DOCUMENTS

| | | | |
|---|---|---|---|
| 2,281,478 | 4/1942 | Chirelstein | 29/749 |
| 2,357,693 | 9/1944 | Samson | 29/757 X |
| 3,284,885 | 11/1966 | Fisher et al. | 29/749 |
| 3,626,431 | 12/1971 | Thierri et al. | 29/748 X |
| 3,861,018 | 1/1975 | Matsuura et al. | 29/757 X |
| 3,956,811 | 5/1976 | Munshower | 29/753 |
| 4,020,540 | 5/1977 | Casciotti | 29/749 |
| 4,040,179 | 8/1977 | Sanchel | 29/747 X |
| 4,043,017 | 8/1977 | Folk et al. | 29/749 |
| 4,110,880 | 9/1978 | Peppler et al. | 29/749 X |
| 4,126,935 | 11/1978 | Rhines et al. | 29/749 X |
| 4,136,440 | 1/1979 | Brandewie | 29/857 |
| 4,148,130 | 4/1979 | Stauffer | 29/749 X |
| 4,159,565 | 7/1979 | Schwalm | 29/747 X |
| 4,174,560 | 11/1979 | Senior et al. | 29/566.1 |

*Primary Examiner*—William R. Briggs

*Attorney, Agent, or Firm*—Michael E. Martin

[57] ABSTRACT

Apparatus for applying connectors to multiconductor electrical flat cable includes a motorized cable feed mechanism for feeding predetermined lengths of cable past a power actuated cable cutter to a connector applying position. Power operated cable clamps are disposed on opposite sides of the connector applying position and are movable in the cable feeding direction to precisely locate the leading or trailing end of the cable at the connector applying position. Connector body and cover magazines are disposed adjacent to the connector applying position. A movable connector holding member includes spring biased jaws for releasably holding a connector body and cover spaced apart on opposite sides of a cable insertion slot. The connector holding member is moved from a connector loading position to the connector applying position wherein power actuated retractable rams are operable to apply a connector to a predetermined length of cable. The connector holding member may be rotated after connector parts are placed on the connector holding member to invert a connector with respect to the cable and other connectors applied to the cable.

28 Claims, 19 Drawing Figures

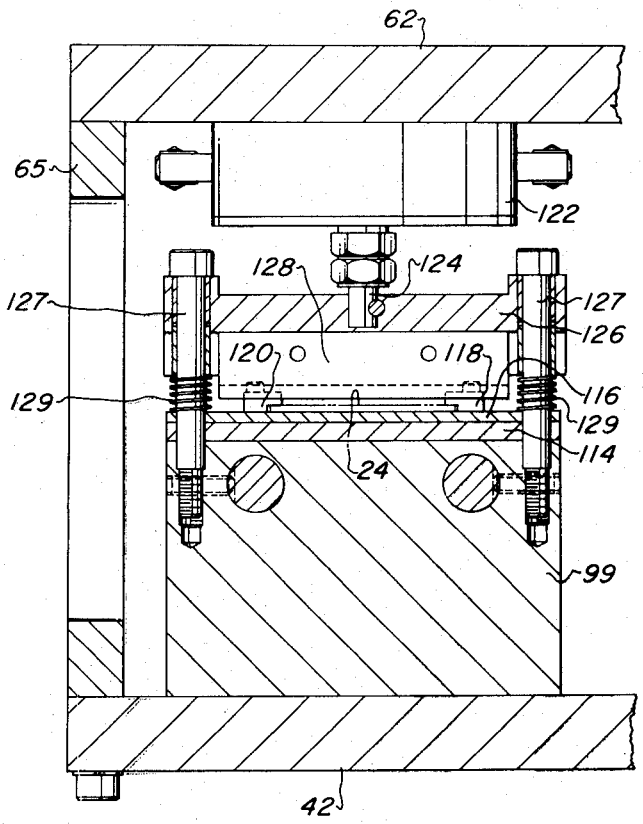
Fig. 6
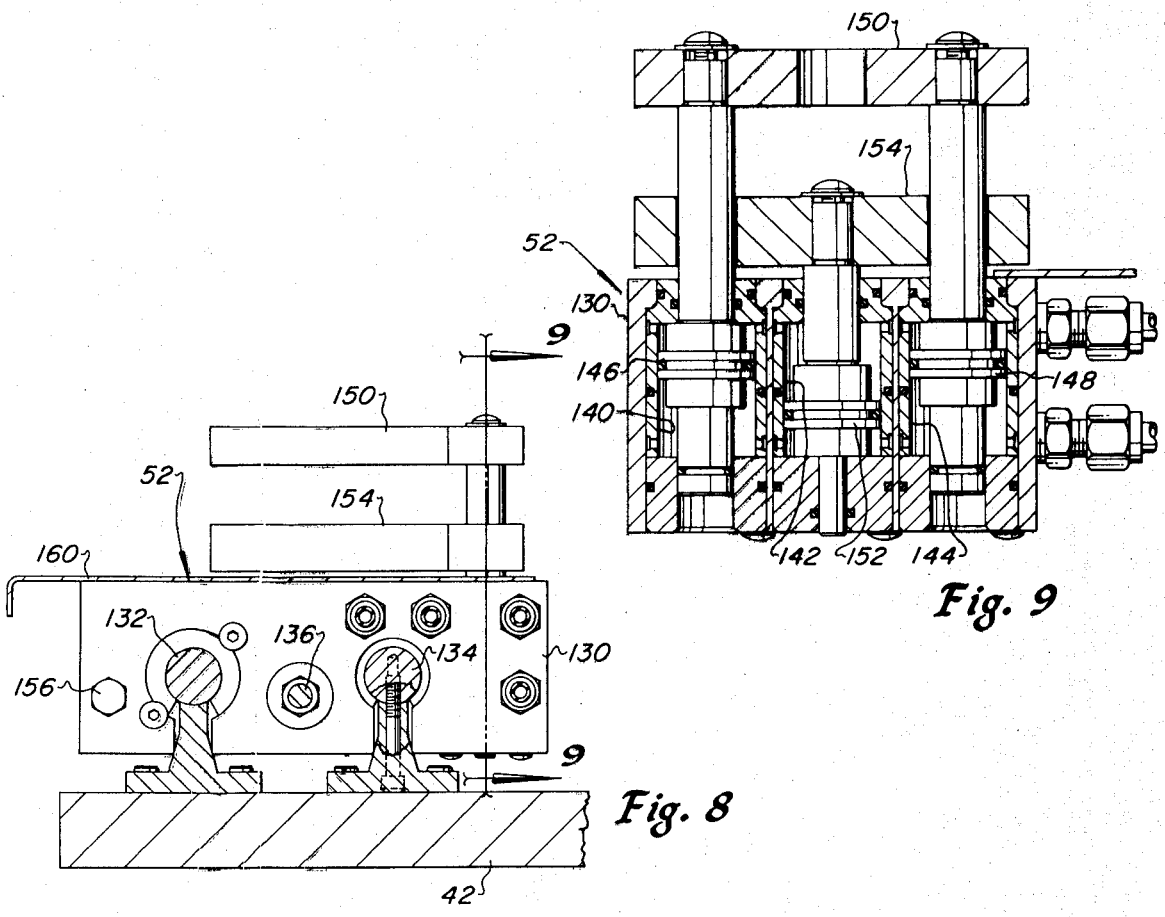
Fig. 9
Fig. 8

APPARATUS FOR APPLYING CONNECTORS TO MULTICONDUCTOR FLAT CABLE

BACKGROUND OF THE INVENTION

This invention pertains to apparatus for substantially automatically assembling connector devices of the insulation piercing terminal type to multiconductor flat electrical cable.

The trend toward increased usage of multiconductor flat cable with high density conductor spacing has brought about a need for apparatus which is capable of accurate alignment and rapid assembly of connectors of the insulation displacement terminal type of the cable.

A need has also developed for apparatus which is capable of substantially automatically preparing predetermined lengths of cable and applying connectors to each end of the cable as well as at predetermined points between the cable ends. Moreover, in the application of connectors to multiconductor flat cable, it is desirable to provide for inverting one or more connectors with respect to other connectors applied to the cable and, accordingly, automatic assembly apparatus with such a capability is also desirable.

Heretofore, known methods and equipment for applying connectors to multiconductor flat cable involve substantially manually actuated bench mounted apparatus such as disclosed in U.S. Pat. Nos. 3,956,811 and 4,020,540 as well as hand-held manual tools including that which is disclosed in U.S. Pat. No. 4,174,560 assigned to the assignee of the present invention.

SUMMARY OF THE INVENTION

The present invention provides an apparatus for automatically preparing predetermined lengths of multiconductor flat electrical cable to which are attached connector devices at one or both ends of the cable as well as at selected positions between the cable ends.

The present invention provides an apparatus for applying connector devices to flexible flat electrical cable which includes cable feed and positioning mechanism for feeding an accurately measured length of cable into positions where connectors may be applied to the opposite ends of the cable as well as at preselected locations along the cable intermediate the cable ends.

The apparatus of the present invention further includes a connector applying mechanism including a member for receiving separate connector cover and body parts from respective magazines and being operable to transfer the connector parts into position for power actuated assembly of the connector parts to the cable. The connector applying mechanism is also operable to invert the connector parts with respect to the cable so that a desired orientation of the connector with respect to the cable may be obtained in assembly.

The apparatus of the present invention still further includes a plurality of magazines for holding and feeding the connector parts into position for loading the parts into the connector receiving and transfer member. Mechanism is provided for selective loading of parts from one of at least two magazines in which the connector cover members are disposed in different orientation with respect to the connector body. The connector part magazines include improved feeding mechanism which provides a substantially constant feed force on the connector parts regardless of the number of parts in the magazine.

A number of objects and superior features of the present invention will become apparent upon reading the following detailed description of the preferred embodiment thereof.

BRIEF DESCRIPTION OF THE DRAWINGS

FIG. 6 is a section view taken from the line 6—6 of FIG. 3;

FIG. 8 is a section view taken from the line 8—8 of FIG. 3;

FIG. 9 is a section view taken from the line 9—9 of FIG. 8;

DESCRIPTION OF THE PREFERRED EMBODIMENT

Figure 2:
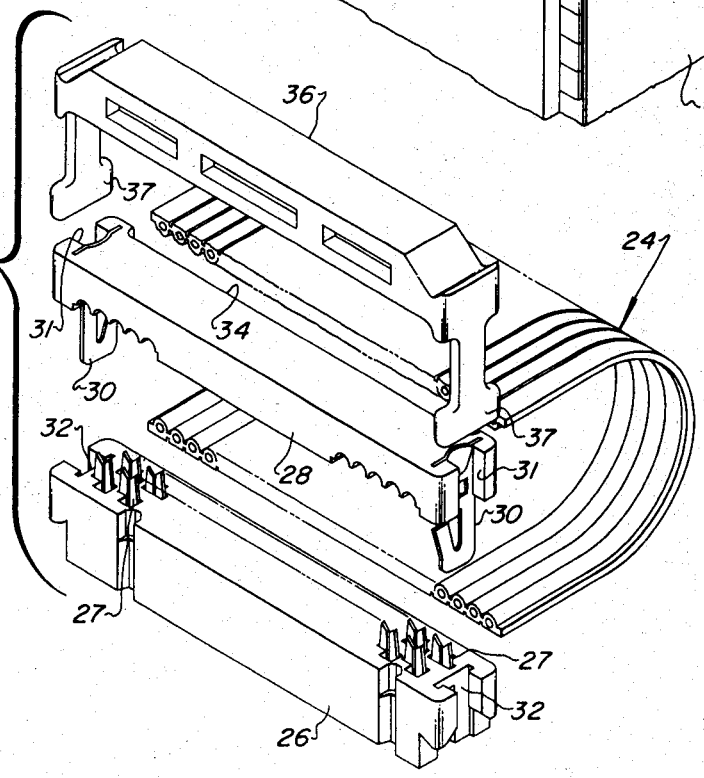
FIG. 2 is a perspective view of the parts of a multicontact connector of the general type which is assembled to multiconductor flat cable by the apparatus of FIG. 1.

The apparatus of the present invention is adapted to apply a connector of the general type shown in FIG. 2 to multiconductor flat cable also shown in FIG. 2 and generally designated by the numeral 24. The connector shown in FIG. 2 includes a body part 26 on which are mounted a plurality of closely spaced insulation displacement terminals 27. The connector shown in FIG. 2 also includes a cover part 28 having elongated slots, not shown, for receiving the ends of the terminals 27. The cover 28 is also provided with clips 30 disposed at the bottom of the respective grooves 31 at opposite ends of the cover. The clips 30 are operable to project into cooperative grooves 32 in the ends of the body 26 to align and hold the body and cover parts in assembly. One side of the cover 28 includes an elongated shallow recess 34 into which the cable may be folded and held against the top of the cover by a strain relief member 36. The strain relief member 36 includes a pair of deflectable arms 37 which are adapted to hold the strain relief member in assembly with the other parts of the connector with the cable clamped therebetween in a known way. The general type of connector shown in FIG. 2 is well known and various specific types are known which differ in certain detailed respects. The specific type of connector shown in FIG. 2 is one of the Scotchflex brand connectors manufactured by the Minnesota Mining and Manufacturing Company, St. Paul, Minn.

Figure 1:
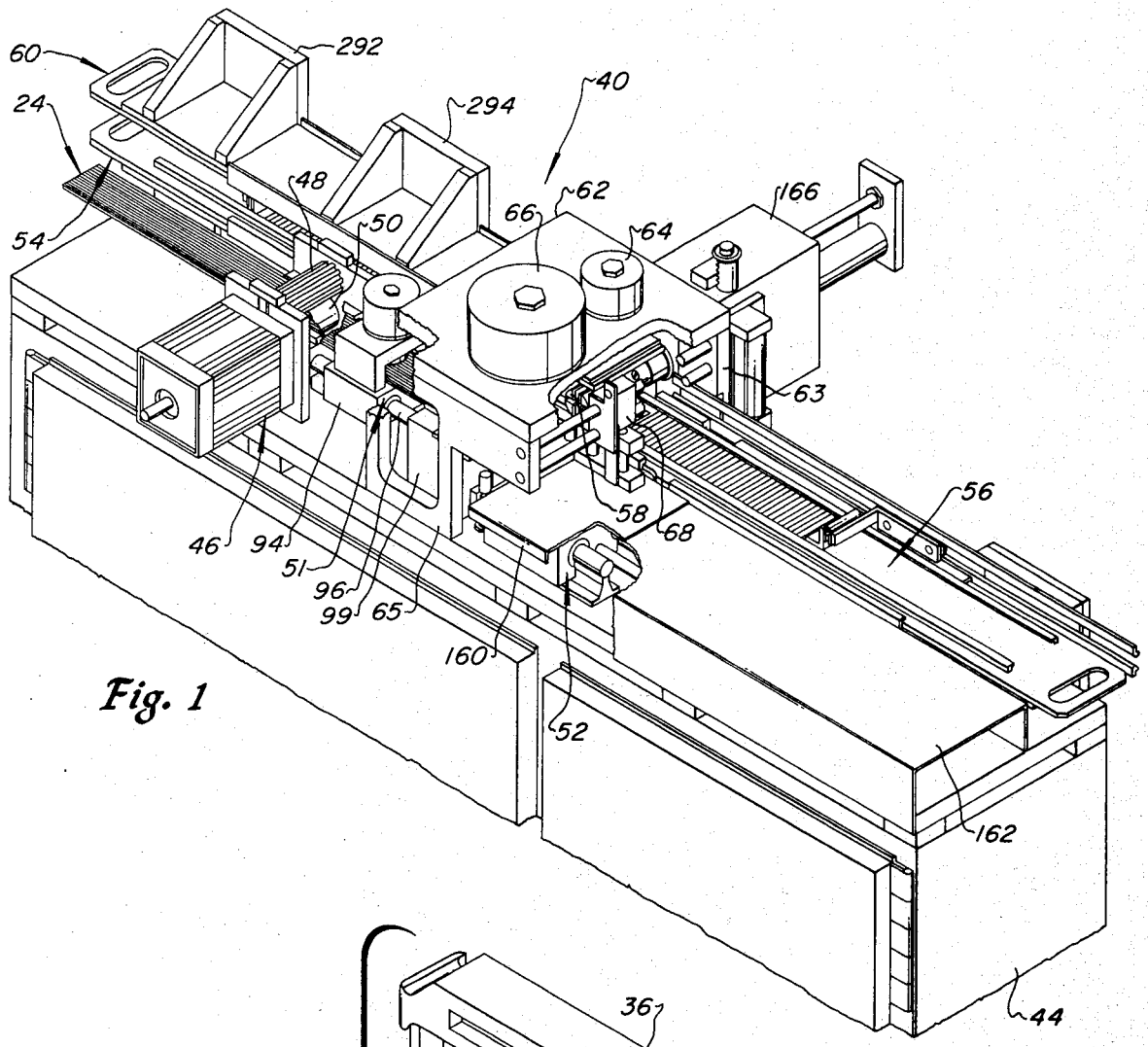
FIG. 1 is a perspective view of the apparatus for automatically applying connectors to multiconductor flat cable according to the present invention.

Referring to FIG. 1 an overall perspective view of the apparatus is shown to facilitate an understanding of the arrangement of the major components. The apparatus of the present invention, generally designated by the numeral 40, includes a frame 42 which is shown mounted on a cabinet 44 which may house some of the control circuitry for operating the apparatus.

The frame 42 is adapted to support a cable feeding unit 46 which is characterized by a pair of motor driven rollers 48 and 50 spaced closely adjacent to each other and engageable with the multiconductor flat cable 24 which may be supplied to the apparatus 40 from a source such as a relatively large roll or the like, not shown.

The apparatus 40 also includes spaced apart cable clamp and transfer units designated generally by the numerals 51 and 52. The cable clamp and transfer units 51 and 52, which will be explained in further detail herein, are operable to position the respective ends of the cable for application of connectors thereto.

The frame 42 also supports elongated magazines 54, and 56 which are aligned with each other on opposite sides of a connector holding member comprising a generally cylindrical shaft designated by numeral 58. The magazines 54 and 56 are adapted to hold a plurality of connector covers side by side. The frame 42 also supports a magazine 60 disposed above the magazine 54 for holding a plurality of connector bodies side by side.

The connector holding shaft 58, partially shown in FIG. 1, is operable to be moved from the position shown wherein connector body and cover parts may be inserted in the shaft to a position wherein the shaft 58 is interposed in the path of the cable 24 and the connector parts may be applied to the cable. The frame 42 includes a bridge portion 62 which includes vertical support plates 63 and 65 and which supports an actuator 64 for loading the connector bodies into the shaft 58 and an actuator 66 for pressing the connector bodies into assembly with a portion of the cable. The bridge portion 62 also supports an actuator 68 which is operable to eject finished cable assemblies from the apparatus 40.

Figure 3:
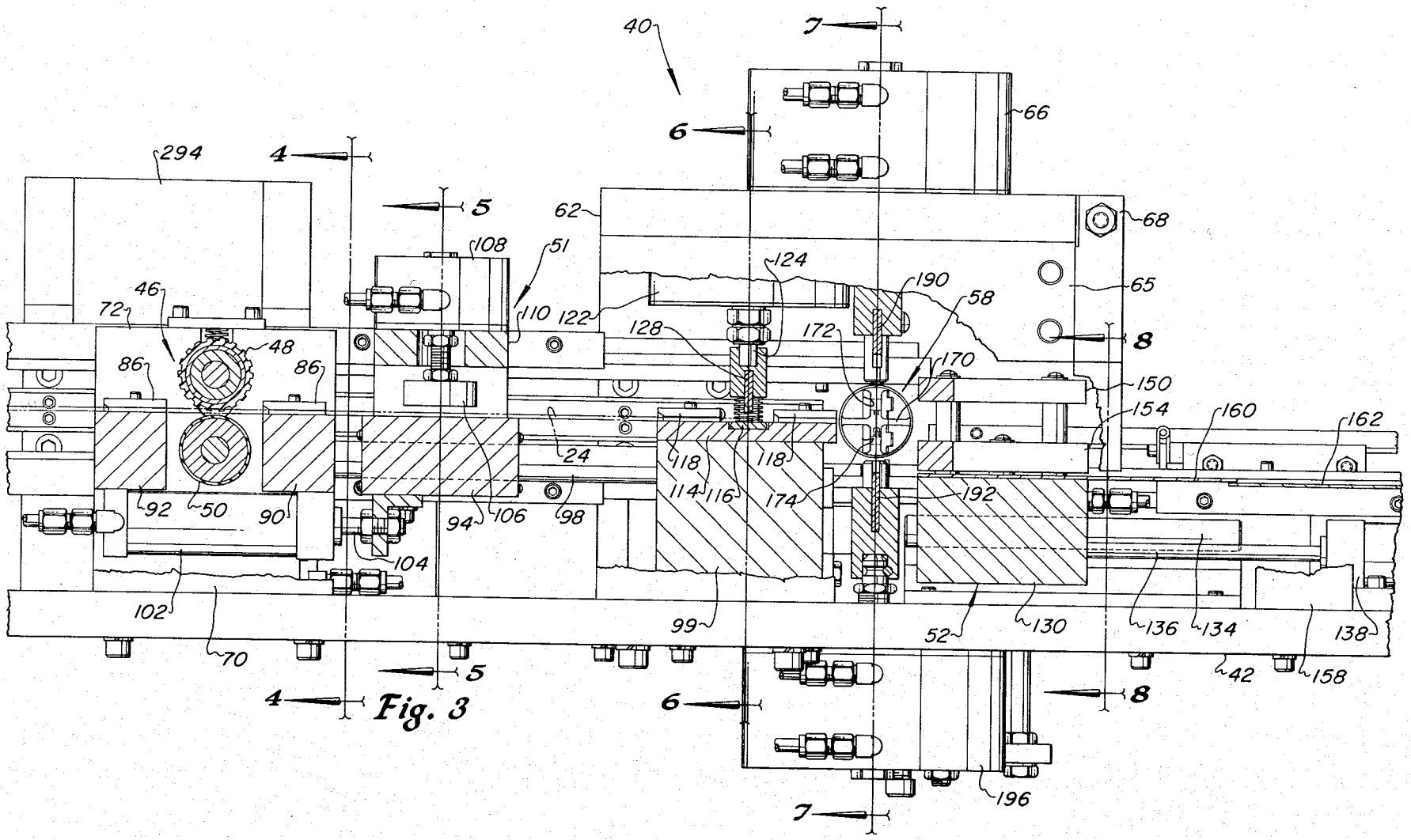
FIG. 3 is a front elevation of a major portion of the apparatus shown in FIG. 1 with some parts broken away and other parts shown in section view taken along the line 3—3 in FIG. 7.
Figure 4:
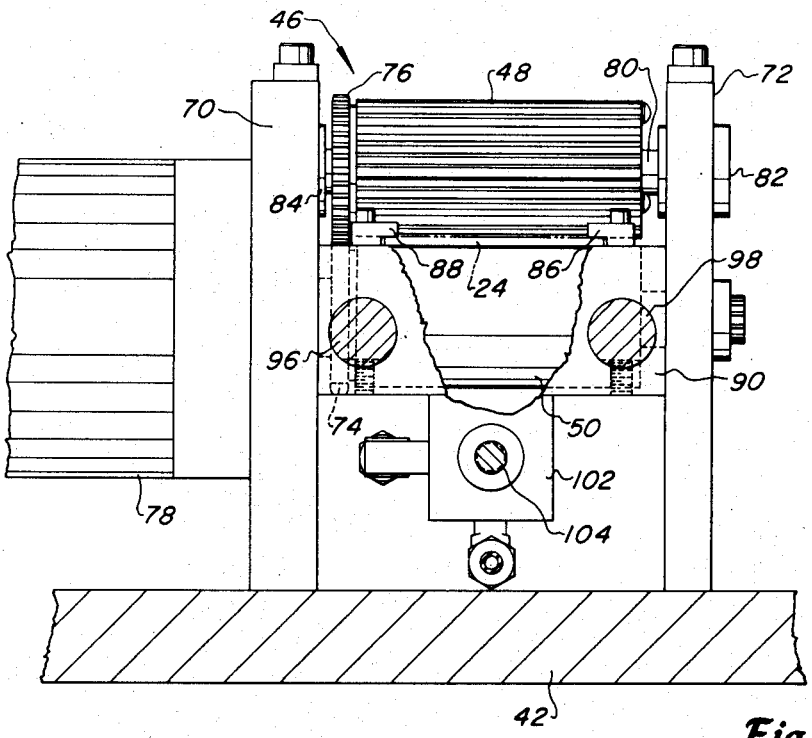
FIG. 4 is a section view taken from the line 4—4 of FIG. 3.

In FIG. 3 the cable feed unit 46 is shown in section view taken from the centerline of the cable feed path. Referring to FIGS. 3 and 4, the rollers 48 and 50 of the cable feed unit are rotatably journalled in suitable bearings which are mounted in spaced apart upstanding supports 70 and 72. The rollers 48 and 50 are drivably engaged with each other by respective gears 74 and 76 and the roller 50 is directly connected to an electric motor 78 which is desirably one which is responsive to rotate a predetermined amount when energized by a pulse type electrical signal and is precisely braked when deenergized. Such motors are commonly known as stepping motors. The bearings supporting the roller 48 are mounted on a shaft 80 which is disposed in blocks 82 and 84 which are movable in vertical slots, not shown, in the brackets 70 and 72 and are spring biased to move the roller 48 toward the roller 50 to forcibly engage the cable 24 disposed between the rollers. Accordingly, when the rollers 48 and 50 are rotated the cable 24 is fed therebetween a linear amount proportional to the angular rotation of the rollers. The cable feed unit 46 also includes cable guides 86 and 88, disposed on transverse supports 90 and 92 and on opposite sides of the rollers 48 and 50, as shown by way of example for the guides 86, in FIG. 3. The guides 86 and 88 are removably mounted on the supports 90 and 92 and may be adjusted relative to each other laterally to accommodate different cable widths.

Figure 5:
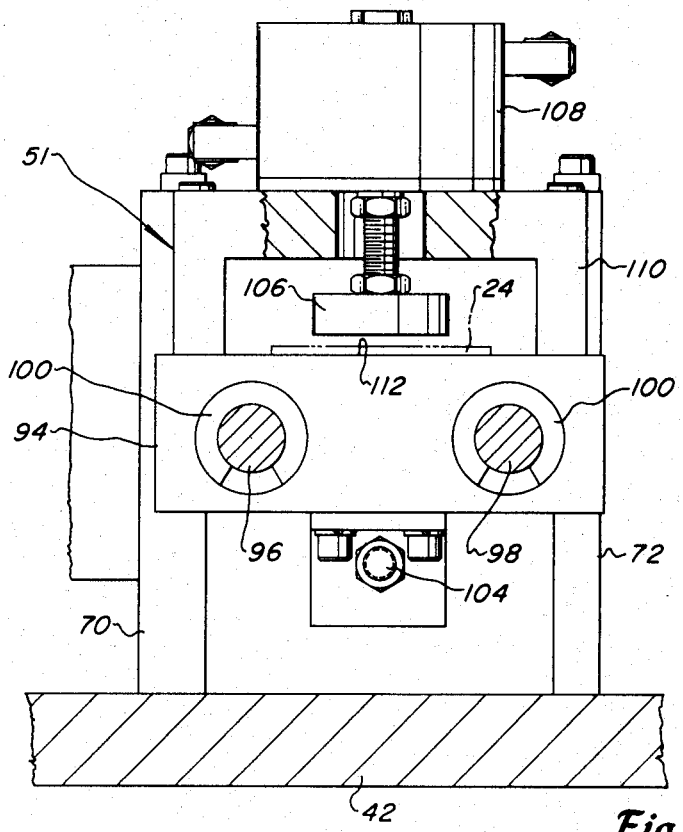
FIG. 5 is a section view taken from the line 5—5 of FIG. 3.

Referring to FIGS. 3 and 5 the cable clamp and transfer unit 51 is shown in further detail. The cable clamp unit 51 includes a support member 94 which is mounted on a pair of spaced apart cylindrical rails 96 and 98 by means of linear bearings 100. The rails 96 and 98 are supported by the member 90 and a base member 99 for a cable cutting mechanism to be described further herein. The support 94 is connected to a pressure fluid cylinder type actuator 102 which is mounted under the transverse members 90 and 92 of the cable feed unit. An extensible piston rod 104 of the actuator 102 is suitably connected at its distal end to clamp unit 51. The clamp unit 51 includes a movable cable clamping jaw 106 which is connected to the piston rod of a pressure fluid actuator 108 mounted on top of a supporting bridge 110. The actuator 108 is operable to releasably clamp the cable between the jaw 106 and a surface 112 on the support 94. The actuator 102 is operable to move the cable clamp unit 51 from the position shown in FIG. 3 toward the connector holding shaft 58 to precisely position the leading edge of the cable in the holding shaft for application of a connector to the cable.

The apparatus 40 also includes the aforementioned cable cutting mechanism which is shown in FIG. 3 and 6. The cable cutting mechanism includes the base member 99 upon which is removably mounted an anvil support plate 114 which supports an anvil 116. The support plate 114 is adapted to support spaced apart cable guides 118 and 120 in one of a plurality of selected positions depending on the width of the cable. The cable guides 118 and 120 are similar to the guides 86 and 88 on the cable feed unit 46. A pressure fluid cylinder type actuator 122, mounted on the bridge 62, is operable to extend and retract a piston rod 124 connected to a cable cutting blade holder 126 in which is mounted a cutting blade 128. The blade holder 126 is guided for reciprocating movement by spaced apart guide pins 127 mounted on the base 99, and the blade holder is biased into the retracted position by coil springs 129 disposed around the pins 127. The actuator 122 is operable to extend the holder 126 to cause the blade 128 to cut a length of cable 24 disposed between the guides 118 and 120.

The cable clamp and transfer unit 52 is disposed beyond the holding shaft 58 in the direction of movement of a length of cable 24 as it is prepared by the apparatus. Referring to FIGS. 3 and 8, the clamp unit 52 includes a housing 130 which is slidably supported on spaced apart rails 132 and 134 mounted on the frame 42. The housing 130 is connected to the piston rod 136 of a double acting cylinder actuator 138 which is mounted on the frame 42, as shown in FIG. 3. Referring also to FIG. 9 the cable clamp unit 52 is further characterized by double acting cylinder actuator means comprising cylinder bores 140, 142, and 144. Pistons 146 and 148 are disposed in the respective bores 140 and 144 and are connected to an upper clamp jaw 150. A piston 152 is disposed in the bore 142 and is connected to a lower clamp jaw 154.

In the position shown in FIG. 3 the piston rod 136 is extended to position the clamp unit 52 adjacent to the holding shaft 58 for receiving the trailing end portion of a length of cable. The jaws 150 and 154 have been retracted away from each other to permit removal of a cable, not shown, with a connector applied to its trailing end or to permit feeding of the leading end of a length of cable, with a connector applied thereto away from the holding shaft 58. The clamp unit 52 is operable to clamp the cable after the leading end of the cable has been moved to the right, viewing FIG. 3, to establish the predetermined length of cable, and prior to cutting the cable to form the trailing end. An adjustable stop 156 is mounted on the housing 130 and is engageable with a bumper 158 mounted on the frame 42. A plate 160 fastened to the housing 130 is provided for supporting the cable as it is fed past the clamp unit 52 and onto a second cable supporting plate 162.

Figure 7:
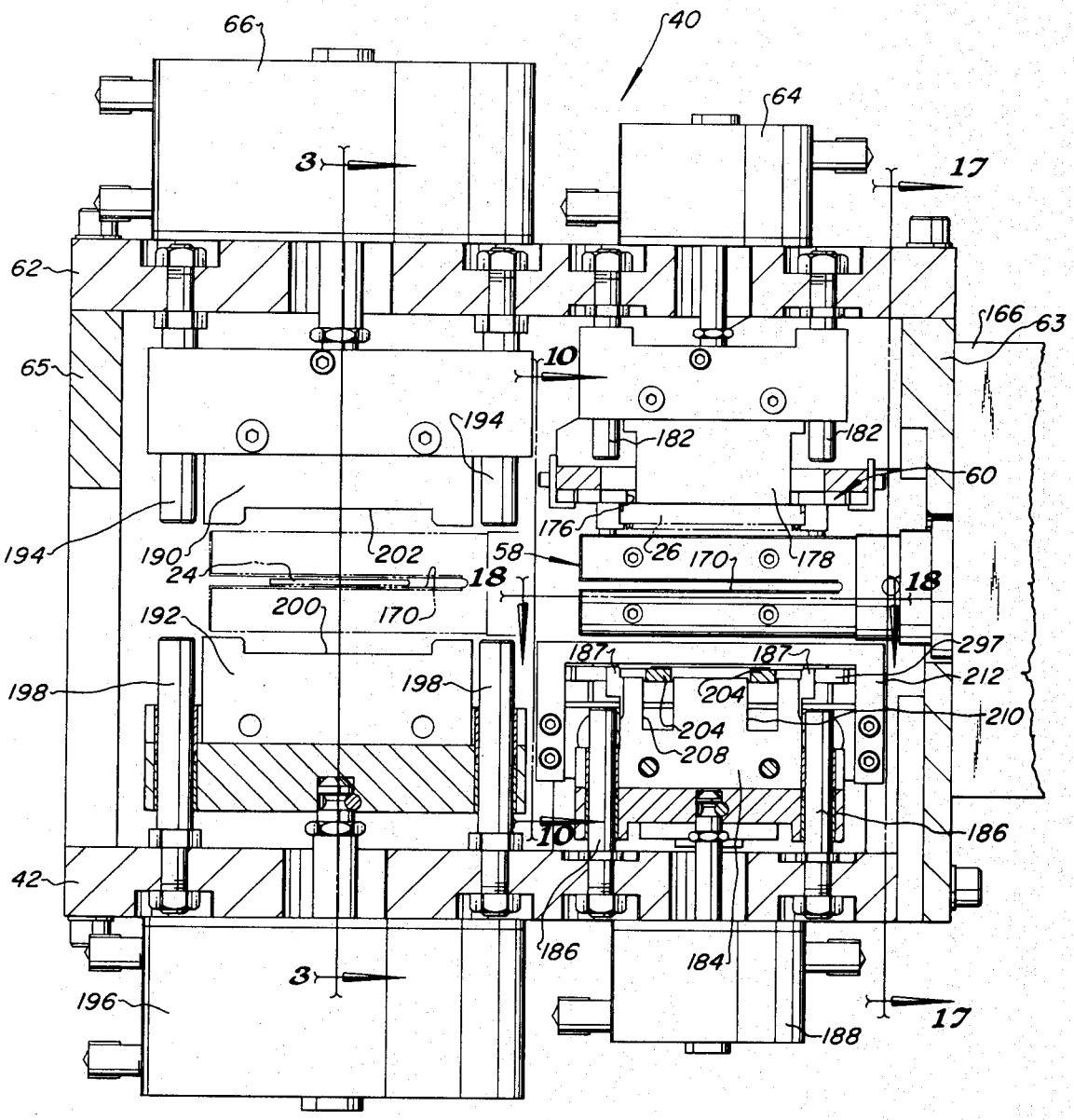
FIG. 7 is a section view taken from the line 7—7 of FIG. 3.

Referring to FIGS. 3 and 7, the connector holding shaft 58 is mounted in a housing 166 fastened to the bridge member 63. The holding shaft 58 includes an elongated slot 170 formed through the central axis of the shaft and opening to the distal end thereof. The slot 170 is formed perpendicular to two aligned slots 172 and 174 which are disposed on opposite sides of the slot 170. The slots 172 and 174 include means disposed therein for receiving and holding a connector body 26 and cover 28, respectively. The connector body and cover holding means will be explained in further detail herein.

Figure 10:
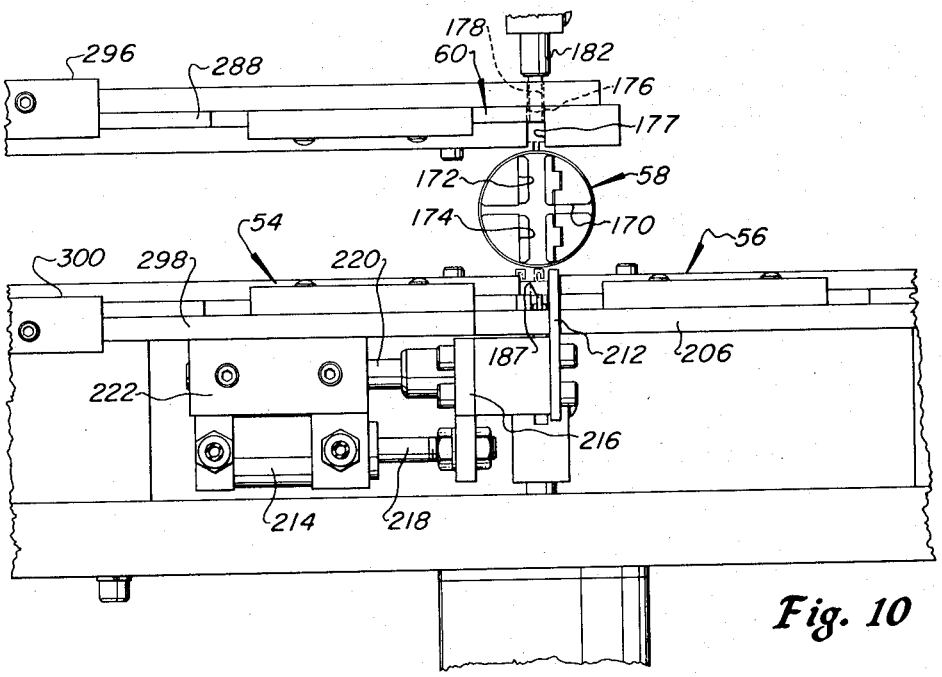
FIG. 10 is a view taken from the line 10—10 of FIG. 7.

The holding shaft 58 is operable to move between the position shown by the solid lines in FIG. 7 and a position illustrated by the dashed lines in FIG. 7. Referring also to FIG. 10, when the holding shaft 58 is in the position shown by the solid lines in FIG. 7 the slot 172 is aligned with a recess 176 formed in the magazine 60 which permits a ram 178 connected to the actuator 64 to push a connector body 26 into the slot. The connector body which is in position to be loaded into the holding shaft 58 is urged by mechanism to be described against a stop 177 while it is still in the magazine 60. The slot 174 is also aligned with an opening between the magazines 54 and 56 for receiving a connector cover 28 from one or the other of the magazines. As shown in FIG. 7, the ram 178 is guided for reciprocating movement in a vertical plane by spaced apart guide rods 182. A similar retractable ram 184 is disposed below the magazines 54 and 56 and is guided for vertical movement in the same plane as the ram 178 by guide rods 186. The ram 184, which is particularly adapted to engage and hold a connector cover 28 of the type shown in FIG. 2, includes spaced apart upwardly extending projections 187 which are operable to extend into the grooves 31 on the opposite ends of the covers for maintaining proper alignment of the cover. The ram 184 is connected to a pressure fluid cylinder type actuator 188.

When a connector body and cover member have been loaded into the holding shaft 58, the shaft is actuated to be extended to the dashed line position shown in FIG. 7. In the extended position of the holding shaft 58 the cable 24 normally extends into or through the slot 170. The slots 172 and 174 are also respectively aligned with opposed rams 190 and 192, shown in their retracted position in FIG. 7. The ram 190 is connected to the cylinder actuator 66 and is guided by spaced apart guide rods 194 for reversible linear movement in a vertical plane. The ram 192 is also connected to a cylinder actuator 196 mounted under the frame 42 and is guided for reversible linear movement by rods 198. The ram 192 as well as the ram 190 may be formed to have interchangeable members having respective recesses 200 and 202 for engaging a particular shape of connector part in accordance with the type of connector being applied by the apparatus 40.

When the holding shaft 58 is moved to the position shown by the dashed lines in FIG. 7 and the cable is disposed in the slot 170 the ram 192 is actuated to move upward, viewing FIG. 7, to engage a connector cover 28 disposed in the slot 174 and move the cover into position directly under and engageable by the cable 24. The ram 190 is then actuated to move downward, viewing FIG. 7, to engage and press a connector body 26 into engagement with the cable 24 and the clips 30 of the connector cover to assemble the connector to the cable. When the connector is applied to the cable the shaft 58 is retracted to the position represented by the solid lines of FIG. 7 and the rams 190 and 192 are subsequently retracted to the positions shown in FIG. 7. The cable is then advanced by the feed mechanism 46 or is ejected by the actuator 68 if the operation involved applying a connector to the trailing end of the cable.

For application of connectors of the type shown in FIG. 2 to the cable ends, it is necessary that the covers 28 be arranged so that the recess 34 is facing in a direction to receive the cable when the cable is folded over the top of the cover prior to application of the strain relief member 36. Accordingly, the covers 28 must be loaded into one or the other of the magazines 54 or 56 such that the recesses 34 of adjacent covers are facing in the opposite direction. Alternatively, covers 28 are loaded into one magazine with the recesses 34 facing in one direction and covers are also loaded into the other of the magazines 54 and 56 with the recesses facing in the opposite direction.

Figure 18:
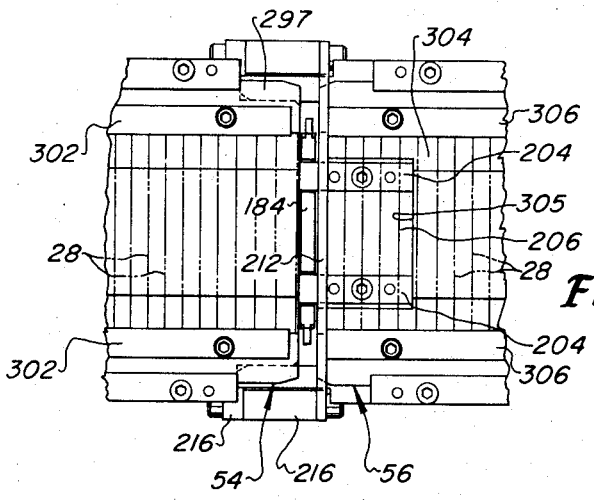
FIG. 18 is a fragmentary view taken from the line 18—18 of FIG. 7; and, FIG. 19 is a view taken from the line 19—19 in FIG. 15.

Selection of a cover 28 from the magazine 54 or 56 for insertion into the holding shaft 58 is provided by mechanism shown in FIGS. 10 and 18. As shown in FIG. 18, two spaced apart support fingers 204 are mounted on a magazine support plate 206 and extend across the opening between magazines 54 and 56 for supporting covers which are moved into positions for insertion into the holding shaft 58. The cover loading ram 184, as shown in FIG. 7, has channels 208 and 210 therein to provide clearance around the fingers 204 when the ram is actuated to insert a cover 28 into the holding shaft 58. The magazine selector mechanism includes a gate characterized by an inverted U-shaped member 212, as shown also in FIG. 7, which extends across the end of the magazine 56 in the position shown in FIG. 18. Referring to FIG. 10, the gate 212 is connected to a pressure fluid cylinder type actuator 214 mounted under the magazine 54. The piston rod 218 of the actuator 214 is connected to an intermediate member 216 which is connected to to the gate 212. Spaced apart guide rods 220, one shown in FIG. 10, extend from the member 216 into complementary bores in a mounting block 222 for the actuator 214. The actuator 214 is operable to move the gate 212 from the position shown in FIG. 10 blocking the feeding of cover parts from the magazine 56 to a position abutting the end of magazine 54 to block the feeding of cover parts from the magazine 54. A similar mechanism and second magazine could, of course, be provided and arranged in a similar way with respect to the magazine 60 for selection of the connector bodies, if desired.

Figure 12:
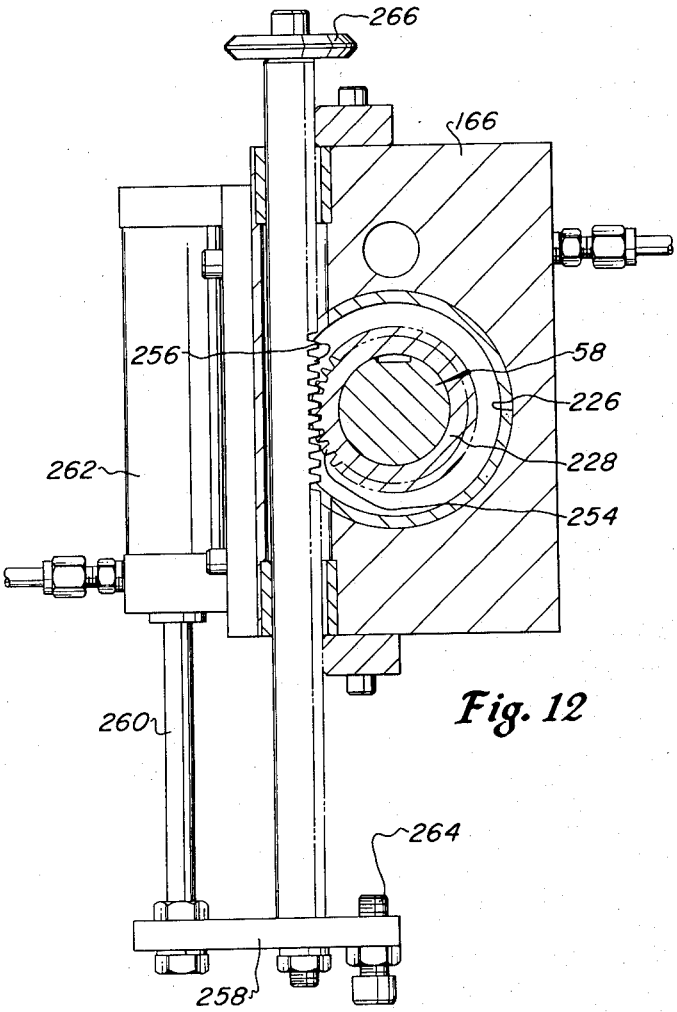
FIG. 12 is a section view taken from the line 12—12 of FIG. 11.
Figure 11:
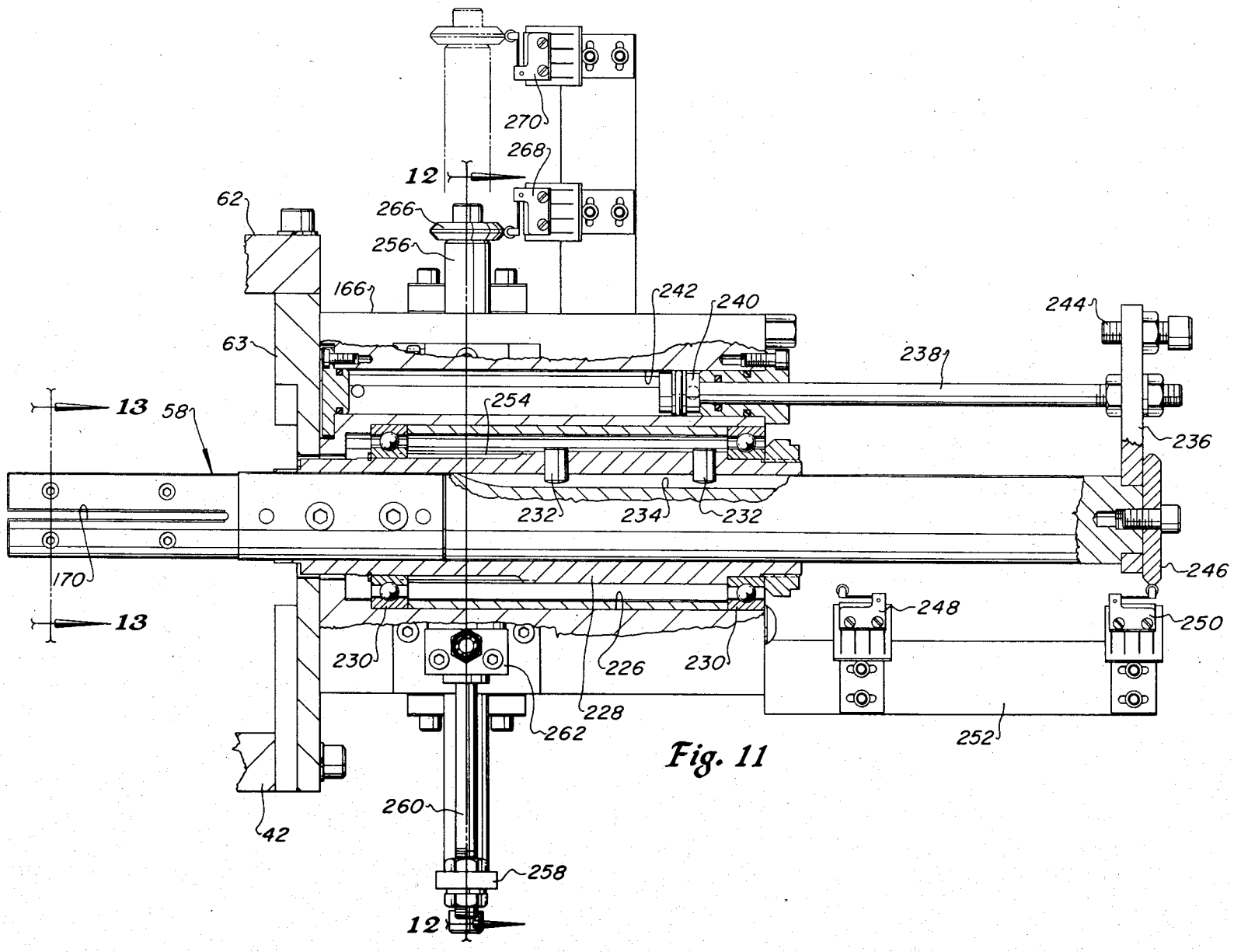
FIG. 11 is a side elevation in section of the connector holding member and actuating mechanism therefor.

Referring to FIGS. 11 and 12, the housing 166 includes an interior bore 226 in which is disposed a tubular sleeve 228 supported for rotation on bearings 230. The holding shaft 58 is mounted in the sleeve 228 and is slidable with respect to the sleeve in opposite directions along the longitudinal coincident central axes of the shaft and sleeve. The sleeve 228 includes two spaced apart keys 232 which project into a key slot 234 formed in the shaft 58 whereby the shaft is longitudinally slidable but nonrotatable with respect to the sleeve. The end of the shaft 58 opposite that which includes the slot 170 is provided with an arm 236 connected to the piston rod 238 of a pressure fluid linear actuator formed by a piston 240 disposed for reciprocation in a bore 242 in the housing 166. The arm 236 includes an adjustable stop 244 engageable with the housing 166 for adjustment of the extended position of the shaft 58 shown by the dashed lines in FIG. 7. A collar 246 mounted on the end of the shaft 58 is adapted to engage spaced apart electrical switches 248 and 250 mounted on a bracket 252 fastened to the housing 166.

As shown in FIG. 12, the sleeve 228 includes an integrally formed gear portion 254 which is meshed with a gear rack 256 disposed for linear reciprocating movement in the housing 166 in directions perpendicular to the longitudinal axis of the shaft 58. An arm 258 connected to one end of the rack 256 is also connected to the piston rod 260 of a pressure fluid cylinder type actuator 262 mounted on the housing 166. The actuator 262 is operable to drive the rack 256 in opposite directions to reversibly rotate the sleeve 228 and shaft 58. An adjustable stop 264 is mounted on the arm 258 for limiting the rotary position of the shaft 58 in one direction of rotation. A collar 266 mounted on the rack 256 is operable to engage a pair of spaced apart switches 268 and 270, as shown in FIG. 11.

Figure 13:
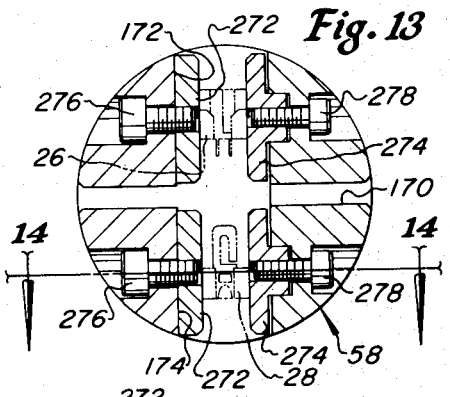
FIG. 13 is a section view taken from the line 13—13 of FIG. 11.
Figure 14:
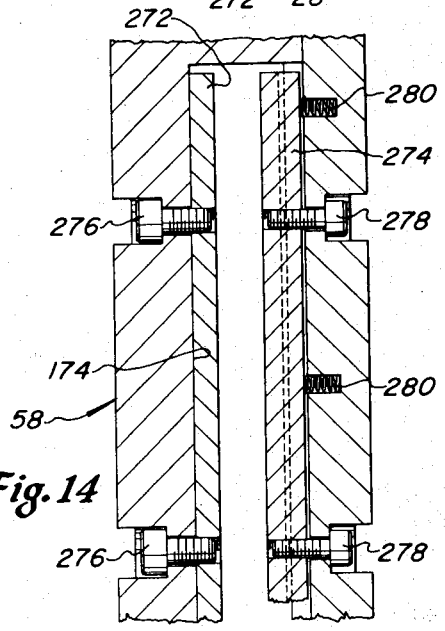
FIG. 14 is a section view taken from the line 14—14 of FIG. 13.

Referring to FIGS. 13 and 14, the slots 172 and 174 are provided with respective sets of connector part gripping jaws 272 and 274. The jaws 272 are detachably secured to the shaft 58 by fasteners 276. As shown by way of example in FIG. 14, the jaws 274 are retained on the shaft 58 by suitable fasteners 278 and are biased toward the jaws 272 by springs 280 interposed between the jaws 274 and a side wall of the slots 172 and 174. Accordingly, the jaws 274 may be yieldably biased into engagement with the connector cover and body parts, respectively, to hold the parts in the shaft 58 until the connector is applied to the cable and the shaft is retracted away from the cable.

Figure 15:
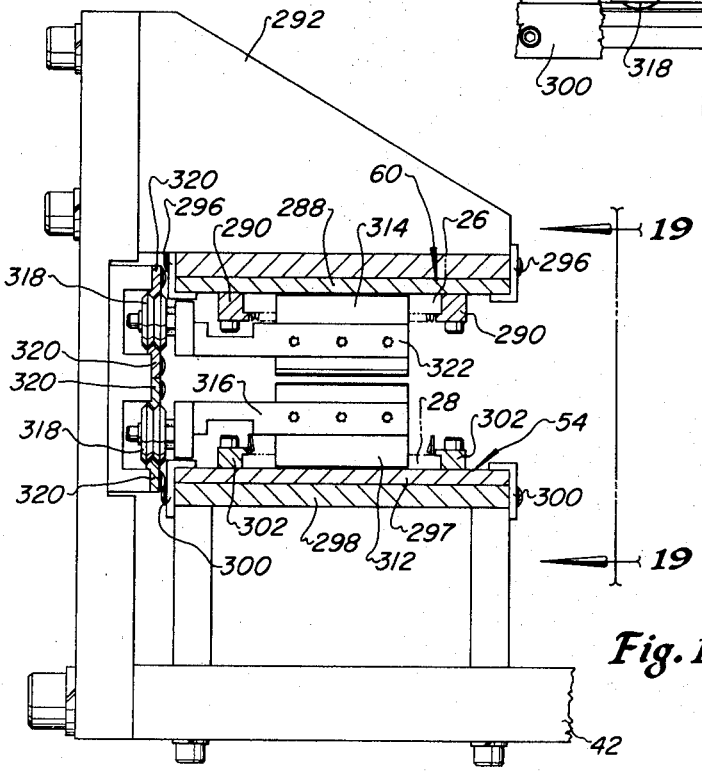
FIG. 15 is a transverse side elevation of the apparatus partially sectioned and illustrating two of the connector magazine feed mechanisms.

FIG. 15 illustrates a transverse elevation of the magazines 54 and 60 and the supporting structure therefor. The magazine 60 comprises an elongated tray 288 including spaced apart guides 290 adapted to retain a plurality of connector bodies 26 on the magazine side by side. The magazine 60 is removably supported on the apparatus 40 by structure comprising spaced apart support members 292 and 294, as shown in FIG. 1, to which are fixed elongated magazine retaining rails 296. The magazine 60 is thus slidably supported by the rails 296 for removal from the apparatus when empty or when a replacement magazine is to be placed on the apparatus 40. The magazine 54 is also characterized by an elongated tray 297 which is removably disposed on a support plate 298 mounted on the frame 42 and also including spaced apart magazine retaining rails 300. The tray 297 is adapted to support a plurality of connector covers 28 side by side and retained on the magazine by spaced apart guides 302.

Figure 16:
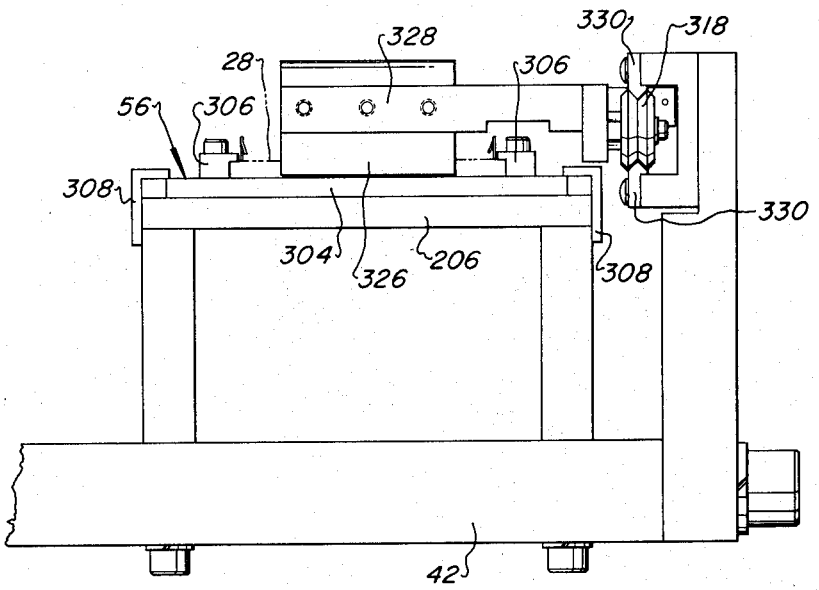
FIG. 16 is a transverse side elevation of the opposite end of the apparatus.

Referring to FIG. 16 also, the second connector cover magazine 56, disposed opposite the magazine 54, is also removably supported on the plate 206 mounted on the frame 42. The magazine 56 also includes an elongated tray 304 adapted to support a plurality of connector covers 28 side by side between spaced apart guides 306. The tray 304 is disposed between oppositely facing guide rails 308. As shown in FIG. 10, the tray 304 includes a recess 305 which provides clearance for the connector cover support fingers 204. The top surfaces of the fingers 204 are even with the top surface of the tray 304.

Figure 19:
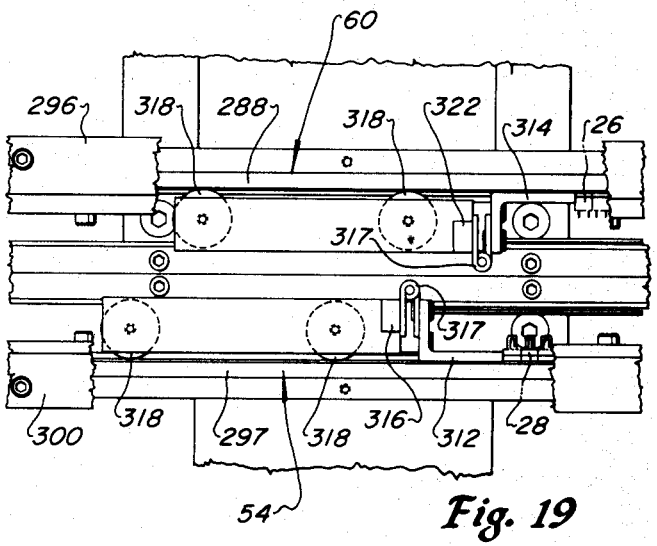

Referring again to FIG. 15 and FIG. 19, the magazines 54 and 60 are respectively provided with movable pusher plates 312 and 314 which feed the connector parts toward the holding shaft 58 for subsequent loading thereinto. The pusher plate 312 is connected to a bracket assembly 376 by means of a spring biased hinge 317 so that the plate may be moved clear of the magazine 54 to permit loading and unloading of the magazine tray 297 with respect to the apparatus 40. The bracket 316 has mounted thereon spaced apart cylindrical rollers 318 which are each provided with a circumferential recess to provide for retaining the rollers between spaced apart tracks 320 mounted on the apparatus 40. The tracks 320 extend parallel to the magazines 54 and 60 to permit movement of the pusher plate 312 substantially the full length of the magazine 54.

The pusher plate 314 is similarly mounted on hinge 317 which is connected to a bracket 322. The bracket 322 is guided for movement along the magazine 60 by a pair of rollers 318 mounted on the bracket and engaged with a second set of tracks 320 mounted above the tracks which guide the pusher plate 312.

Referring to FIG. 16 the magazine 56 is also provided with a hinged pusher plate 326 for moving the connector covers toward the holding shaft 58. The pusher plate 326 is mounted on a bracket 328 similar to the brackets 316 and 322 and which is similarly mounted for guided movement along spaced apart parallel tracks 330.

Figure 17:
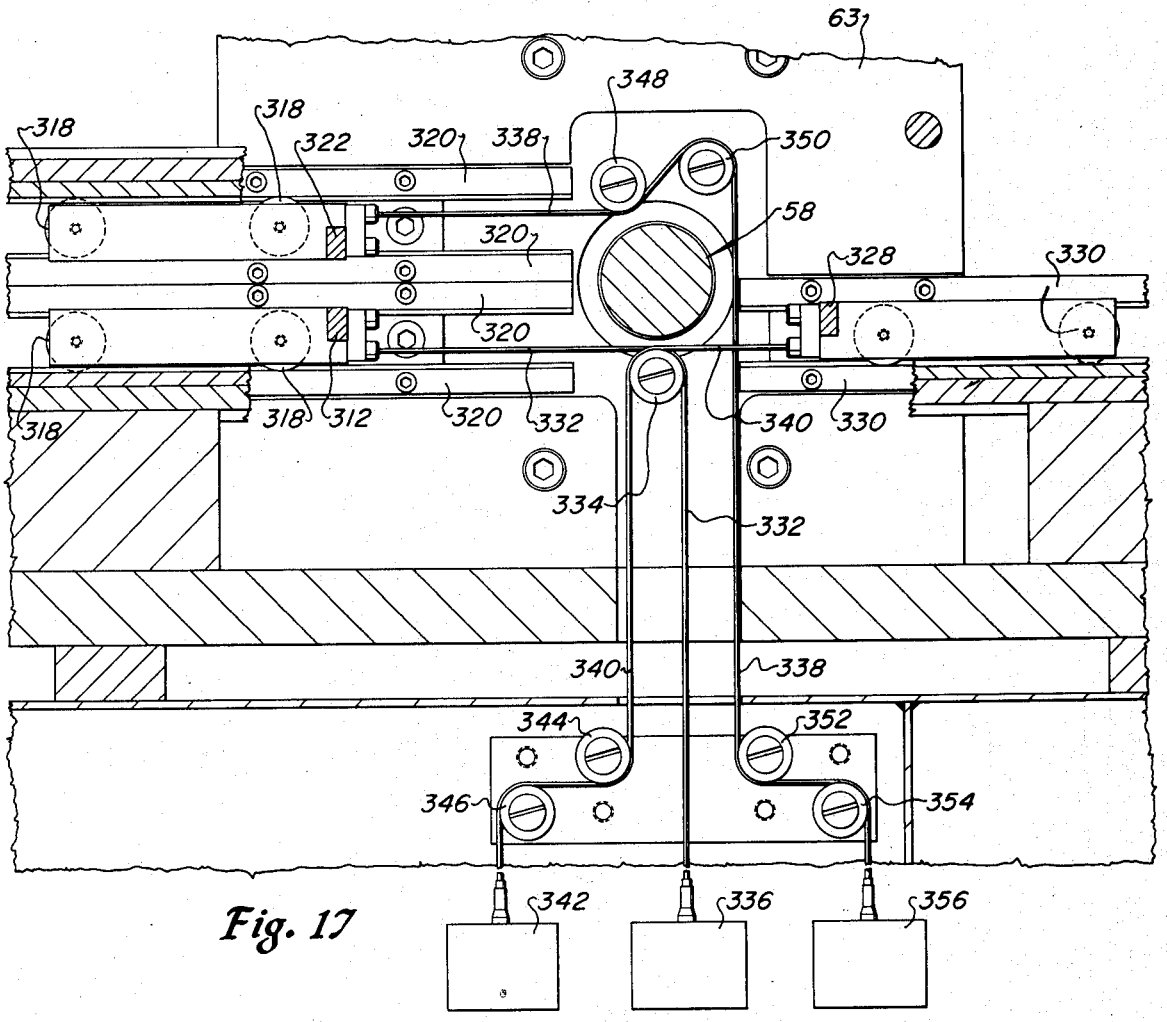
FIG. 17 is a view taken from the line 17—17 of FIG. 7 and illustrating the magazine feed mechanism.

The pusher plates 312, 314, and 326 are biased into engagement with the connector parts disposed in the respective magazines 54, 60, and 56 by mechanism which provides a substantially constant feed or bias force on the connector parts disposed in the magazines regardless of the number of parts remaining in the respective magazines at any one time. Referring to FIG. 17 the bracket 312 is shown connected to a flexible cable 332 which is trained over a sheave 334 mounted on the vertical support plate 63. The opposite end of the cable 332 is connected to a hanging weight 336. In like manner the brackets 332 and 328 are also connected to flexible cables 338 and 340, respectively. The cable 340 is connected to a weight 342 and is trained over a sheave mounted next to sheave 334, not shown, and sheaves 334 and 346 provide for spacing the weight 342 from the weight 336. The cable 338 is similarly trained over sheaves 348, 350, 352 and 354 and is connected to a weight 356. Since the weights 336, 342, and 356 exert a constant downward force on the cables, the feed force exerted by the respective pusher plates remains substantially constant regardless of the number of connector members remaining in the magazines.

The apparatus 40 may be operated in a preferred mode by a suitable electrical control system comprising electrical proximity or limit switches, some of which are illustrated in the drawings, together with time delay devices and logic devices which are operable to actuate solenoid valves for supplying pressure fluid to the various actuators included in the apparatus in a predetermined sequence. Such a control system also would preferably include a control circuit for energizing the motor 78 of the cable feed unit 46 to feed a predetermined amount of cable through the apparatus.

An operating cycle of the apparatus will now be described assuming that a cable assembly has previously been prepared and the apparatus is ready for another operating cycle. Prior to commencement of an operating cycle the leading edge of the cable would be positioned at the cut line of the cutting blade 128. The cable cutting blade 128 and the clamp units 51 and 52 would be in a retracted condition. The rams 178, 184, 190 and 192 would be retracted and the connector holding shaft 58 would be in the position shown by the solid lines in FIG. 7.

An operating cycle would commence with energization of the actuators 64 and 188 to cause the respective rams 178 and 184 to insert a connector cover and body into the slots 172 and 174 in the holding shaft 58. The rams 178 and 184 are then retracted and pressure fluid is introduced into the bore 242 to cause piston 240 to move the shaft 58 to the position represented by the dashed lines in FIG. 7. Simultaneously, with the energization of the holding shaft actuator the cable clamp 106 is actuated to clamp the cable. After the holding shaft 58 is moved into position to receive the cable which is signalled by actuation of the switch 248, FIG. 11, the cylinder actuator 102 is actuated to move the clamp unit 51 to the right, viewing FIG. 3, from the position shown so that the leading end of the cable is inserted into the holding shaft slot 170 between the connector cover and body parts 26 and 28.

When the cable is positioned in the holding shaft 58 the actuator 196 is energized to move the ram 192 upward to move the connector cover up to the cable and provide support for the cover. The actuator 66 is then sequentially energized to cause the ram 190 to press the connector body into engagement with the cable and the connector cover to complete the assembly process.

After a connector is applied to the leading edge of the cable the holding shaft linear movement actuator is caused to retract the holding shaft 58 to the position shown by the solid lines in FIG. 7. The rams 190 and 192 and the clamp jaw 106 are also subsequently retracted after a short time delay. The feed motor 78 is then energized by a predetermined repeating pulse signal which varies in accordance with the length of cable to be fed to thereby cause the feed unit 46 to feed a predetermined length of cable past the cutting blade 128. During the cable feed process the actuator 102 returns the clamp unit 51 to the position shown in FIG. 3 and the actuator 214 moves the gate 212 so that a connector cover having its recess turned opposite to that of the cover previously applied may be positioned for loading into the holding shaft 58. If a connector is to be applied intermediate the ends of the length of cable being prepared or if connector covers without special nonsymmetric configuration were being used, actuation of the gate would not be necessary until one of the magazines was empty. After movement of the gate 212, as the case may be, the rams 178 and 184 are actuated to load another connector into the holding shaft 58. When the cable is fed out a predetermined amount, the cable clamp unit 52 is actuated to cause jaws 150 and 154 to move together clamping the cable therebetween. The holding shaft 58 is then subsequently moved into the connector application position. When the shaft 58 is in position with the cable inserted in the slot 170 the actuator 122 is energized to cut the cable and then deenergized to cause the cutting blade 128 to retract to the noncutting position.

When the cutting blade 128 is retracted a limit switch is actuated which provides for operation of the actuator 138 to move the clamp unit 52 to the right, viewing FIG. 3, to place the trailing end of the cable in position for application of the connector thereto. Movement of the clamp unit 52 to the limit position will actuate a suitable limit switch, not shown, which causes sequential actuation of the rams 192 and 190 as described previously to apply the connector to the trailing end of the cable. The holding shaft 58 is then retracted and the clamp jaws 150 and 154 are released.

When the holding shaft 58 is retracted to engage the switch 250, FIG. 11, suitable solenoid valves are actuated to cause the rams 192 and 190 to be retracted, and to move the gate 122 back to its initial position. Simultaneously, the actuator 68 is energized to eject a completed cable assembly toward the front of the apparatus for removal therefrom. After a suitable time delay the actuator 138 is energized to return the clamp unit 52 to the position shown in FIG. 3. When the clamp unit 52 reaches its starting position, a suitable limit switch, not shown, is actuated to condition the control circuit for another operating cycle.

In the application of a connector to a cable at either end of the length of cable or at some intermediate point between the cable ends, it is sometimes desired to invert the connector with respect to the cable as well as the other connector or connectors applied to the cable. If inversion of the connector was desired, the control circuit would cause the actuator 262, FIG. 12, to rotate the holding shaft 58 after the connector parts were loaded into the slots 172 and 174 and the loading rams were retracted to cause the connector body and cover positions to be interchanged and inverted with respect to their positions upon being loaded in the holding shaft. The holding shaft 58 would then be extended to the dashed line position shown in FIG. 7 and the operating cycle would proceed as previously described. Upon retraction of the holding shaft 58, after completion of a connector application, the actuator 262 would be reversed to rotate the holding shaft back to its original rotative position preparatory to receiving another connector.

What is claimed is:

1. Apparatus for applying a two-part electrical connector to flat multiconductor cable comprising;

a frame;

a cable feed mechanism disposed on said frame and operable to feed a predetermined length of cable along a predetermined path on said frame;

connector holding means disposed on said frame for holding said connector parts spaced apart one part from the other, said connector holding means being operable to be moved between a first position for receiving said connector parts and a second position adjacent to said path so that said connector parts are disposed on opposite sides of said cable; and means on said frame for engaging said connector parts in said second position of said connector holding means and moving said connector parts to apply said connector to said cable.

2. The invention set forth in claim 1 wherein:

said apparatus includes cable cutting means interposed between said feed mechanism and said connector holding means for cutting said cable to predetermined lengths.

3. The invention set forth in claim 2 wherein:

said apparatus includes a first clamping means interposed between said feed mechanism and said connector holding means for releasably clamping said cable, said first clamping means including an actuator for moving said clamping means to position said cable for applying a connector thereto.

4. The invention set forth in claim 3 wherein:

said first clamping means is disposed between said feed mechanism and said cutting means and is operable to position the leading edge of said cable in position to apply a connector thereto.

5. The invention set forth in claim 3 wherein:

said apparatus includes second clamping means for releasably clamping said cable, said second clamping means being disposed on said frame beyond said holding means in the direction of movement of said cable through said apparatus.

6. The invention set forth in claim 5 wherein:

said second clamping means includes an actuator for moving said second clamping means to position the trailing end of a length of cable in position to apply a connector thereto.

7. The invention set forth in claim 5 wherein:

said second clamping means includes power actuated opposed clamping jaws arranged on said second clamping means for movement toward each other to a cable clamping condition and away from each other to a nonclamping condition.

8. The invention set forth in claim 1 wherein:

said means for engaging and moving said connector parts includes a pair of opposed rams operable to engage said connector parts disposed in said connector holding means for forcing said connector parts toward each other.

9. The invention set forth in claim 1 wherein:

said apparatus includes magazine means for holding a plurality of each of said connector parts and means for transferring said connector parts from said magazine means to said connector holding means prior to application of a connector to said cable.

10. Apparatus for applying a two-part electrical connector to flat multiconductor cable comprising:

a frame;

a cable feed mechanism disposed on said frame and operable to feed a predetermined length of cable along a predetermined path on said frame;

magazine means disposed on said frame for holding a plurality of each of said connector parts;

connector holding means disposed on said frame comprising a holding member for holding said connector parts spaced apart, one part from the other, said holding member being movable between a first position for receiving at least one of each of said connector parts from said magazine means and a second position wherein said connector parts are disposed on opposite sides of said cable;

means disposed on said frame for transferring said connector parts from said magazine means to said connector holding means prior to application of a connector to said cable; and means for engaging and moving said connector parts toward each other in said second position of said holding member to apply said connector to said cable.

11. The invention set forth in claim 10 wherein:

said means for transferring said connector parts from said magazine means comprises a pair of opposed rams operable to engage, respectively, said connector parts comprising a body and a cover disposed in said magazine means and move said body and said cover onto said holding member.

12. The invention set forth in claim 10 wherein:

said holding member includes means forming a pair of slots aligned in such a way as to receive a body and a cover spaced apart one from the other, a third slot formed in said holding member between said pair of slots and substantially perpendicular thereto for receiving a portion of said cable when said holding member is in said second position.

13. The invention set forth in claim 12 together with:

holding jaws disposed in said pair of slots for releasably gripping said body and said cover, respectively, and means for yieldably biasing said holding jaws into engagement with said body and said cover.

14. The invention set forth in claim 13 wherein:

said apparatus includes housing means for supporting said holding member for movement between said first position and said second position, and an actuator connected to said holding member for moving said holding member between said first and second positions.

15. The invention set forth in claim 14 wherein:

said holding member is connected to actuating means for rotating said holding member to change the relative positions of said connector parts after said connector parts are loaded into said holding member whereby a connector may be applied to said cable in an inverted position.

16. The invention set forth in claim 15 wherein:

said actuating means for rotating said holding member comprises a sleeve slidably supporting said holding member for linear movement with respect to the sleeve, said sleeve being rotatably mounted on said housing for rotating said holding member, said sleeve including gear means, and a gear rack engaged with said gear means and connected to an actuator for rotating said sleeve and said holding member in response to operation of said actuator.

17. The invention set forth in claim 10 wherein:

said magazine means comprises first and second magazines for holding, respectively, a plurality of connector parts, said first and second magazines being disposed on said apparatus adjacent to said holding member when said holding member is in said first position.

18. The invention set forth in claim 17 wherein:

said first and second magazines each comprise elongated connector part holding trays removably mounted on said apparatus and said holding member is disposed between said trays and adjacent to one end of said first magazine and one end of said second magazine.

19. The invention set forth in claim 18 together with:

a third magazine disposed on said apparatus spaced from and aligned with one of said first and second magazines for holding a plurality of connector parts facing opposite to those parts disposed in said one magazine.

20. The invention set forth in claim 19 together with:

a gate disposed on said apparatus to alternately block said third magazine and said one magazine from feeding connector parts to said holding member, and an actuator connected to said gate for selectively moving said gate to block said third magazine or said one magazine.

21. The invention set forth in claim 17 wherein:

said connector parts are disposed in said magazines side by side and said apparatus includes means engaged with said connector parts for biasing said parts toward said holding member.

22. The invention set forth in claim 21 wherein:

said means for biasing said parts includes a pusher plate engaged with at least one of said parts disposed in respective ones of said magazines and means connected to said pusher plate for imposing a substantially constant feed force on said connector parts for urging said parts toward said holding member.

23. The invention set forth in claim 22 wherein:

said means connected to said pusher plate includes a hanging weight and means including flexible cable means interconnecting said weight and said pusher plate.

24. The invention set forth in claim 23 wherein:

said apparatus includes elongated guide means disposed on said apparatus adjacent to said magazines and substantially parallel to the feed path of said connector parts disposed in said magazines and a member mounted on said guide means and connected to said cable and said pusher plate.

25. The invention set forth in claim 1 wherein:

said holding means includes a holding member forming a pair of slots aligned in such a way as to receive, respectively, at least one each of said connector parts comprising a body and a cover spaced apart one from the other, a third slot formed in said holding member between said pair of slots and substantially perpendicular thereto for receiving a portion of said cable when said holding member is moved to said second position.

26. Apparatus for applying a two-part electrical connector to flat multiconductor cable comprising:

a frame;

a cable feed mechanism disposed on said frame and operable to feed a length of cable along a predetermined path on said frame;

connector holding means including a holding member disposed on said frame for receiving and holding said connector parts spaced apart one part from the other, said holding means being operable to be disposed in relation to said cable so that said connector parts are disposed on opposite sides of said cable;

actuating means connected to said holding means for rotating said holding member to change the relative positions of respective ones of said connector parts after said connector parts have been received by said holding member; and means for engaging and moving said connector parts to apply said connector to said cable.

27. The invention set forth in claim 26 wherein:

said holding member includes means forming a pair of slots aligned in such a way as to receive said connector parts comprising a body and a cover spaced apart one from the other, and a third slot formed in said holding member between said pair of slots and substantially perpendicular thereto for receiving a portion of said cable.

28. The invention set forth in claim 27 together with:

holding jaws disposed in said pair of slots for releasably gripping said body and said cover, respectively, and means for yieldably biasing said holding jaws into engagement with said body and said cover.

* * * * *

UNITED STATES PATENT AND TRADEMARK OFFICE

CERTIFICATE OF CORRECTION

PATENT NO. : 4,281,442

DATED : August 4, 1981

INVENTOR(S) : Robert B. Senior, et al

It is certified that error appears in the above—identified patent and that said Letters Patent is hereby corrected as shown below:

Column 2, line 64, "of the respective" should be ---of respective---.

Column 8, line 55, "332" should be ---322---.

Column 8, line 59, "334" should be ---344---.

Column 10, line 23, "gate 122" should be ---gate 212---.

Signed and Sealed this

*Seventeenth* Day of *November 1981*

[SEAL]

*Attest:*

GERALD J. MOSSINGHOFF

*Attesting Officer*

*Commissioner of Patents and Trademarks*